United States Patent [19]

Baummer

[11] Patent Number: 5,057,211

[45] Date of Patent: Oct. 15, 1991

[54] BENEFICATION APPARATUS AND PROCESS FOR LAND AND SEABED MINING

[76] Inventor: George P. Baummer, 25 Strabane Ct., Baltimore, Md. 21234

[21] Appl. No.: 649,157

[22] Filed: Feb. 1, 1991

Related U.S. Application Data

[63] Continuation of Ser. No. 286,239, Dec. 19, 1988, abandoned.

[51] Int. Cl.[5] ..... B03B 5/66; B03B 11/00

[52] U.S. Cl. ..... 209/448; 209/496; 209/498; 209/504

[58] Field of Search ..... 209/422, 437–442, 209/446, 448, 458–460, 485, 488–490, 494, 496–499, 503, 504, 508

[56] References Cited

U.S. PATENT DOCUMENTS

| | | | |
|---|---|---|---|
| 45,341 | 12/1864 | Prater | 209/446 |
| 347,909 | 8/1886 | Woods et al. | 209/44 |
| 370,646 | 9/1887 | Paine | 209/442 |
| 537,945 | 4/1895 | Tarrant | 209/498 X |
| 597,617 | 1/1898 | Paine | 209/446 |
| 666,796 | 1/1901 | Brash | 209/446 |
| 941,634 | 11/1909 | Godley | 209/448 |
| 1,314,335 | 8/1919 | Kellogg | 209/438 |
| 1,387,075 | 8/1921 | Rueger | 209/439 |
| 1,470,011 | 10/1923 | Johnesse | 209/446 |
| 2,484,203 | 10/1949 | Beck | 209/446 |
| 3,367,499 | 2/1968 | Motosi | 209/504 X |
| 3,537,581 | 11/1970 | Baummer | 209/437 |
| 3,966,593 | 6/1976 | Larsson | 209/479 |
| 4,120,783 | 10/1978 | Baummer | 209/18 |

*Primary Examiner*—Kevin P. Shaver
*Assistant Examiner*—Edward M. Wacyra
*Attorney, Agent, or Firm*—Hurt, Richardson, Garner, Todd & Cadenhead

[57] ABSTRACT

A mineral benefication apparatus having a housing, including opposed stratification hoppers arranged at its lower periphery. Particulate material and water are introduced separately into the housing, which is then oscillated to separate a portion of the particulate material. The apparatus can be modified to operate either on land or in a sea environment.

23 Claims, 5 Drawing Sheets

BENEFICATION APPARATUS AND PROCESS FOR LAND AND SEABED MINING

This is a continuation of copending application Ser. No. 07/286,239 filed on Dec. 19, 1988, now abandoned.

BACKGROUND OF THE INVENTION

1. Field of the Invention

This invention relates to an improved mechanical mineral beneficiation apparatus and process, and is more particularly concerned with a method and apparatus which concentrates the heavier constituents of particulate material without having to additionally separate the particulate material from a fluvial transport within a configuration in which the expansion of the apparatus for the purpose of increasing unit capacity is not inseparably tied to factors which, upon such expansion, adversely affect the stratification portion of the process.

2. Description of the Prior Art

Mineral beneficiation, and particularly classification of particulate material according to relative weight, was greatly improved by the Apparatus and Process for Ordinary and Submarine Mineral Beneficiation, as disclosed in my U.S. Pat. No. 4,120,783. The method and apparatus disclosed in the '783 patent eliminated many of the disadvantages of the prior art devices such as tables, and undercut sluice types such as the spiral, the cone, the Lamflo concentrator and the undercut sluice tray by, inter alia, providing a closed chamber for the introduction of a slurry of the particulate material. The '783 patent eliminated the unbroken common flow path of the particulate matter and fluid carrier, present in prior devices, which necessitates a flow velocity sufficient to transport the full range of particle sizes in the slurry, and thus substantially eliminated the resulting hydrologic equilibrium that occurs in a fluvial transport between particles of different specific gravities because of their sizes and shapes. Other advantages included the elimination of a fixed enrichment ratio; the elimination of restrictive-common-adjustments affecting more than one function; the elimination of any middlings product; the elimination of feed density as a factor in process efficiency; the elimination of slurry flow rate as a factor in process efficiency; and the elimination of surface tension and its negative effect on mechanical mineral processing. Other advantages of the '783 patent included providing a means to control exposure time of particulate matter through the stratification portion of the process. It also provided a means to accommodate both barren ore and ore "hot spots" with a floating enrichment-ratio that automatically responds to changing ore conditions, and it also provided a means to monitor, program and automatically control the entire process. The method and apparatus disclosed in the '783 patent, however, included many limitations. In that device, a slurry is introduced into the housing against a baffle that directed the slurry outwardly against the housing. The slurry is then passed through various separation zones. Therefore, the particulate material feed and flow path is combined with the fluid and fluid flow path through a substantial portion of the process circuit. Because of this, hydrologic equilibrium can still occur, although to a far lesser degree than in prior art devices. The result of the hydrologic equilibrium effect is a non-linear recovery of the valuable constituents caused by the relatively finer valuable particles being held in suspension and flushed through the process circuit in the fluvial transport and thus lost in the waste product. Further, the process of the '783 patent necessitates that the particulate matter ultimately be separated from its fluvial transport. Another important limitation of the device and its process is that the area of highest concentration of the desired product (the valuable constituents) is not coordinated with the point of discharge for this product. This is because the lowest point of the stratification zone and the point of discharge are toward the center of the housing, and away from its periphery, therefore the centrifugal forces generated by the oscillation of the housing tends to move the heavier concentrate away from the housing center and generally adversely affects the process. With the invention herein disclosed, the centrifugal forces are utilized to enhance the separation and stratification process having placed the lowest point of the stratification zones and the point of concentrates discharge at the periphery of the process housing. Finally, and one of the more serious limitations to commercializing the process of the '783 patent is in that configuration the angles and the depth that define the stratification zone, which are critical factors for efficient mechanical separation, are inseparably tied to, and change with the expansion of the process housing which is necessary for increasing unit capacity. With the present invention there are multiple stratification zones located at the periphery of the process housing which can be incorporated in any number required to meet any desired unit capacity, each designed with optimum depth and angles independent of the size of the process housing.

SUMMARY OF THE INVENTION

Briefly described, the present invention includes a housing open to the environment in which it is used, either ambient atmospheric pressure or the undersea environment, defining an upper feed compartment, lower stratification hoppers and a centrally disposed tailings hopper. Adjustably supported within the housing is a central deflector which assists in defining the feed hopper, and which defines with the housing an annular passageway into the stratification hoppers. The level of particulates contained in the feed hopper is controlled by the placement of the feed conduit, and the level of particulates contained in the tailings hopper is controlled by electronic sensors and electronically controlled valves. Similarly, the concentration of ore is selectively controlled in the stratification hoppers by automatic, electronic sensors and associated valves. In operation, particulate material is introduced into the feed hopper of the housing through a feed conduit. In land applications, water can be used to assist the process, or the process can be employed without a fluid medium. In processing on land using water, the water is introduced into the housing within the central deflector, by a water input conduit. Thus, the water and the particulate material are separately introduced within the system. When the Particulate material and water are elevated to desired levels, the housing is oscillated back and forth about a vertical axis, which causes the particulate material contained within the work area to be stratified according to relative weight. The vertical position of the central deflector within the housing is adjusted to control the slope of particulate material toward the tailings hopper. This central deflector, along with the adjustment of the amplitude and frequency of oscillation of the housing, effectively controls the flow rate of particulate material through the process circuit. Since the introduction of water and particulate material entering and exiting the housing is automatically controlled using a combination of the placement of elements and electronically controlled sensors and valves, the entire process is fully automatic, resulting in selectively controlled concentrations of work product in an automated manner.

Other embodiments of the present invention disclose alternative mounting means and oscillating means for imparting movement to the apparatus. Other embodiments also incorporate multiple units in a single, large capacity unit, and disclose embodiments which allow for submarine applications.

Accordingly, it is the object of the present invention to provide a mineral beneficiation apparatus and process which are durable in structure, efficient in operation, and while retaining the advantages achieved by the '783 patent, provide the additional advantages and improvements which are considered necessary to commercialize the process.

Another object of the present invention is to provide a mineral beneficiation apparatus in which the particulate matter feed and flow path are separate from, and are not influenced by, the fluid flow path through the entire process circuit.

Another object of the present invention is to provide a mineral beneficiation process which eliminates the need to separate the particulate matter from the fluvial transport within the circuit.

Another object of the present invention is to provide a mineral beneficiation process which is automatically controlled, and which results in preselected concentrations of the ore.

Another object of the present invention is to provide a mineral beneficiation apparatus in which the work areas are located at the periphery of the apparatus.

Another object of the present invention is to provide a mineral beneficiation process in which the point of highest ore concentration and the point of the concentrates discharge are precisely coordinated.

Another object of the present invention is to provide particulate matter through the process circuit can be incrementally adjusted.

Another object of the present invention is to provide a mineral beneficiation process in which the particulate material flow path through the process circuit is gravity induced without the aid of a fluvial transport.

Another object of the present invention is to provide a mineral beneficiation process in which centrifugal force is effectively utilized to enhance the separation and stratification of the particulate material.

Another object of the present invention is to provide a mineral beneficiation apparatus in which unit capacity can be increased without sacrificing optimum performance.

Another object of the present invention is to provide a mineral beneficiation apparatus and process which can be utilized either for submarine or land applications.

Another object of the present invention is to provide a mineral beneficiation process which efficiently recovers desired constituents of very fine size ranges.

Other objects, features and advantages of the present invention will become apparent from the following description when taken in conjunction with the accompanying drawings, wherein like characters of reference designate corresponding parts throughout the several views.

DESCRIPTION OF THE PREFERRED EMBODIMENTS

Figure 1:
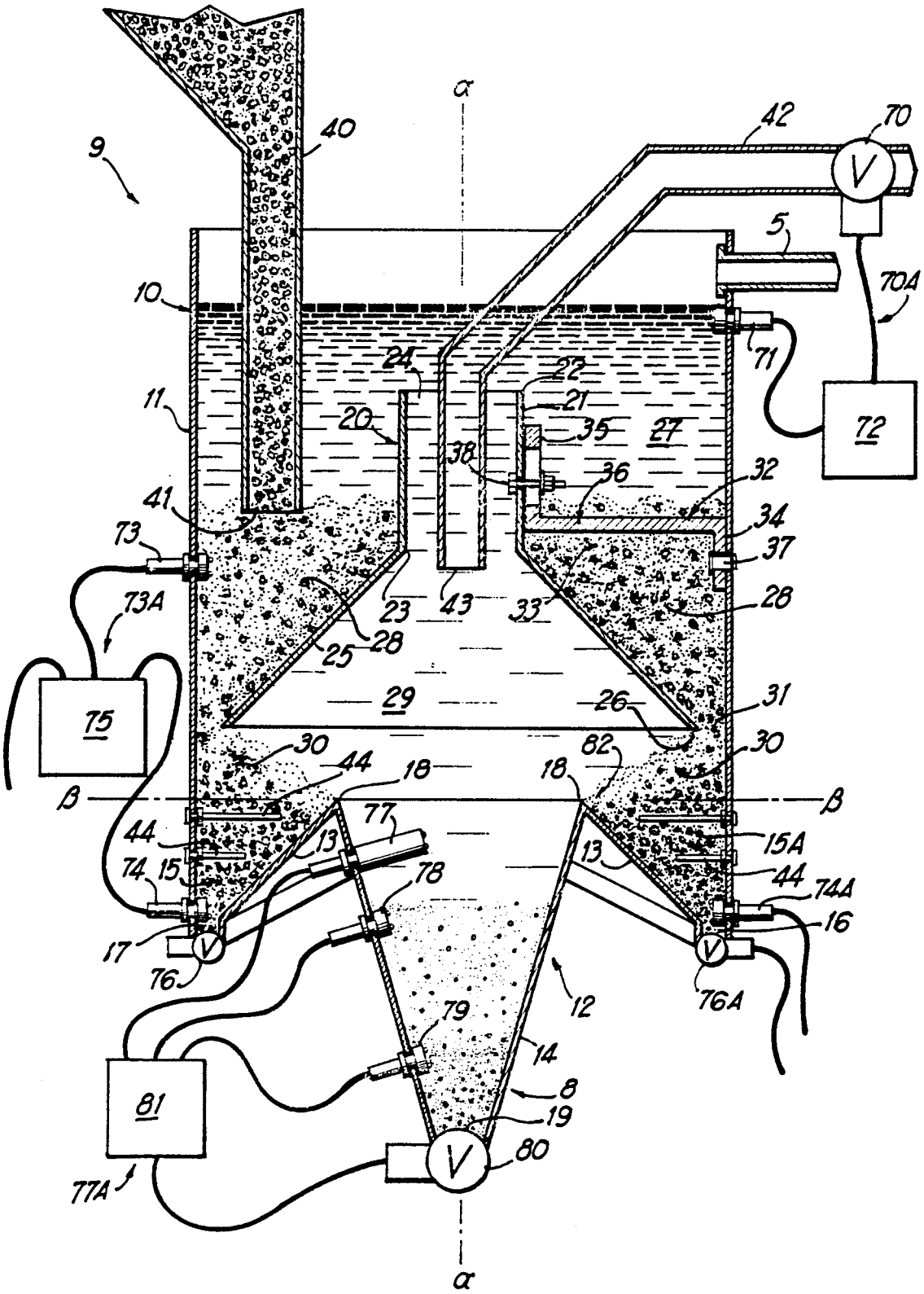
FIG. 1 is a vertical, sectional view of the mineral beneficiation apparatus of the present invention as adapted for land applications.

Referring now in detail to the embodiments chosen for the purpose of illustrating the present invention, numeral 9 denotes generally the mineral beneficiation apparatus which includes a cylindrical housing 10, having cylindrical side wall 11 defining a hollow interior, and a bottom wall 12 which includes upwardly extending, conical tailings hopper 8, concentric with respect to housing 10, as shown in FIG. 1. Inwardly angled wall 13 of bottom wall 12, and cylindrical side wall 11 define opposed stratification hoppers 15 and 15A. One or more hopper(s) 15 can be employed within the apparatus 9. The lower portions of walls 11 and 13 are arranged in spaced relationship to define concentrates outlet conduits 16 and 17. Similarly, side walls 14 of tailings hopper 8 terminate in spaced relationship at their lowermost point to define tailings outlet conduit 19. Walls 13 and 14 converge upwardly to define an arcuate, annular ring dam or spillway having an upper lip or edge 18 in a radial plane.

A hollow, upright, tubular frustoconical deflector 20 is disposed concentrically within the interior of housing 10. The upper portion of deflector 20 includes a hollow, tubular, cylindrical neck 21 which is open at both its upper end at edge or annular lip 22, and at its lower end or edge 23, and having a central vertical passageway 24. The lower end 23 is integrally joined to the upper circular edge of the frusto-conical body or skirt 25 of deflector 20 to form a common edge. The skirt 25 flairs or diverges downwardly and outwardly from the neck 21 and terminates at its lowermost portion in a circular, peripheral edge 26, disposed in a radial plane. Edge 26 terminates in a spaced relationship to the inner portion of side wall 11. Deflector 20, therefore, separates the chamber of housing 10 onto an upper chamber 27 with a particulate or feed hopper 28 and a lower chamber 29 with lower hopper 30, the lowermost portion of which includes stratification hoppers 15 and 15A. Stratification hoppers 15 and 15A are further defined by side walls 11 and 13. Feed hopper 28 is in communication with lower hopper 30 through annular passageway 31 which is defined by the spaced relationship of peripheral edge 26 to side wall 11. Upper chamber 27 communicates with lower chamber 29 through central, vertical passageway 24 of deflector 20.

As best shown in FIG. 1, central deflector 20 is selectively, adjustably mounted within upper housing 10 by means of adjustable support assembly 32. Support assembly 32 is comprised of square steel, angled rod 33, having vertical arms 34 and 35 and horizontal arm 36. Vertical arm 34 is received within and anchored by collar 37 which is securely mounted to the interior of wall 11.

Vertical arm 35 defines a centrally disposed elongated channel (not shown) therein. Neck 21 of deflector 20 also contains therein a hole through which externally threaded bolt 38 passes with its shank also extending through the channel of vertical arm 35. A washer or nut on bolt 38 securely affixes deflector 20 to support assembly 32. It is therefore seen that deflector 20 can be selectively, incrementally, vertically adjusted within upper housing 10. The length of horizontal portion 36 is such that deflector 20 is concentrically disposed within upper housing 10 along axis alpha. As shown in FIG. 1, bottom wall 12 is secured to housing 10 so that tailings hopper 8 is also disposed in concentric relationship to deflector 20 and to upper housing 10 along vertical axis alpha.

Extending into chamber 27 of housing 10 is feed conduit 40. Feed conduit 40 projects into chamber 27 to a selected extent so that the level of particulate material in hopper 28 is selectively controlled by the position of the lowermost end 41 of conduit 40. Water feed conduit 42 extends downwardly into vertical passageway 24 of neck 21 so that the lowermost end 43 of conduit 42 is within deflector 20. Water overflow conduit 5 projects from the upper portion of sidewall 11 of housing 10. Elongated rods or agitators 44 are mounted at one end in side wall 11 so that the free ends of rods 44 extend into stratification hoppers 15 and 15A. As shown in FIG. 1, preferably at least two rows of rods 44 extend in spaced relationship to each other into hoppers 15 and 15A. Each row of rods 44 is arranged radially around the interior periphery of side wall 11 within hoppers 15 and 15A.

Mounted within outlet conduits 16 and 17 are electronically operated valves 76A and 76, which selectively, independently control the material discharged from the respective conduit in which the valve is mounted, as described later. Further, mounted within tailings conduit 19 is electronically operated valve 80 which selectively controls the material discharged from tailings hopper 8. Similarly, also contained within water feed conduit 42 is an electronically controlled valve 70, which selectively permits the induction of water or other fluid into housing 10.

Figure 2:
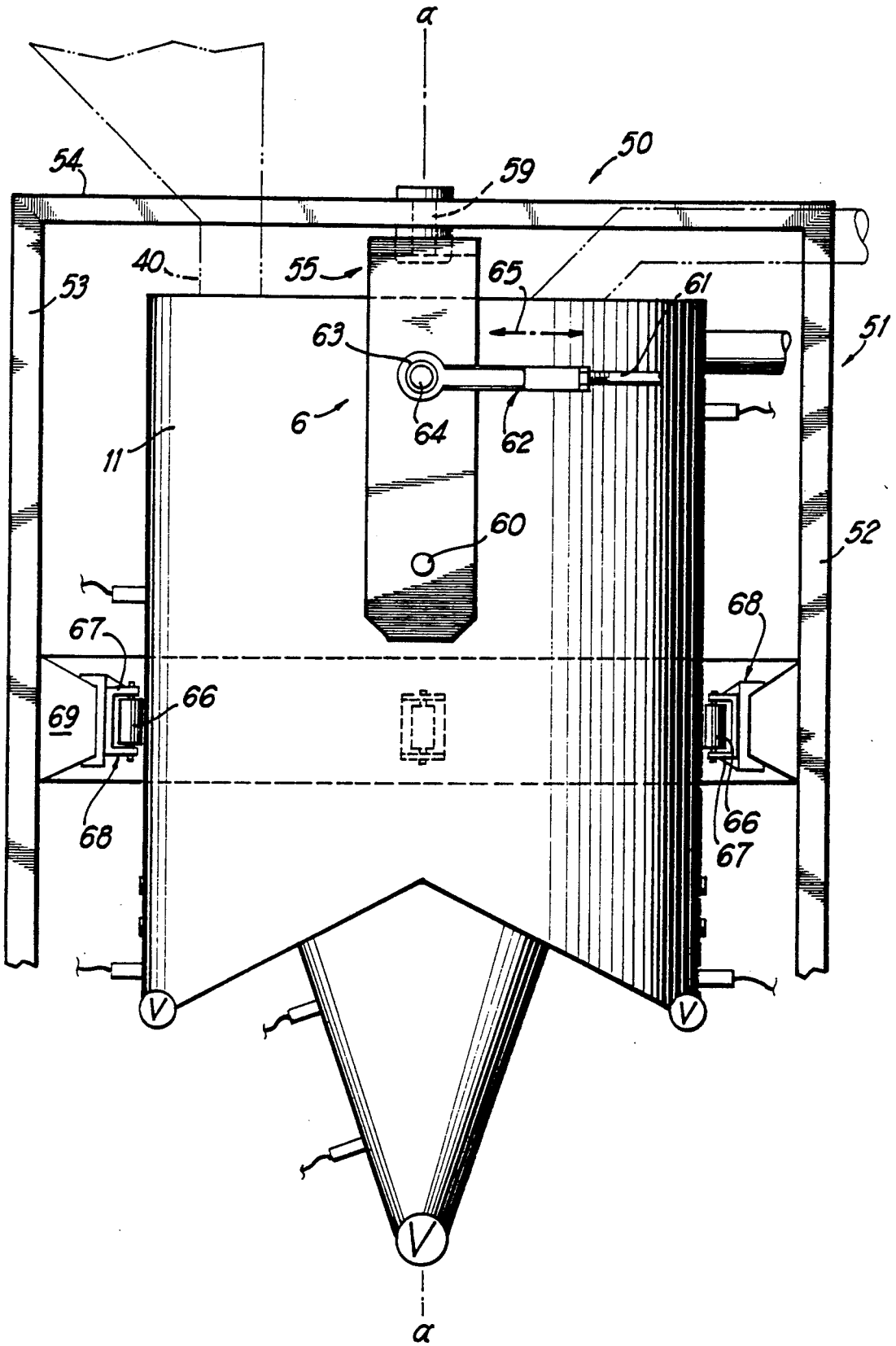
FIG. 2 is a side elevational view of the exterior of the apparatus shown in FIG. 1, the apparatus being supported by a frame structure for rocking or oscillatory movement.

Referring now to FIG. 2, the gimble support assembly 50 for housing 10 includes an inverted U-shaped primary frame 51 having spaced, parallel upstanding standards or struts 52 and 53. The upper ends of the standards 52 and 53 are joined by a horizontal, laterally extending crossbeam 54. Below crossbeam 54 is an oscillating assembly 6, including a smaller, inverted, U-shaped bale or strap 55 having spaced, vertical, parallel arms 56 and 57 (not shown on drawing), the upper ends of which are joined by a horizontal crossbar 58 (indicated by dotted line) which extends beneath the central portion of beam 54. A pivot shaft 59 along axis alpha connects the midportions of beam 54 and crossbar 58. Trunnions 60 which protrude from opposite sides of the housing 10, namely sidewall 11, are received by the lower ends of arms 56 and 57 for isolating the strap 55 about axis alpha. Reciprocating rod 61 leading from a suitable prime mover such as a crank (not shown) of a motor (not shown) is employed, as is well known in the art. The rod 61 is connected to a turnbuckle 62 and a self-aligning bearing 63, to a stub shaft 64 protruding from one arm 56. Thus, when rod 61 is reciprocated as indicated by arrow 65, the strap 55 will be rocked back and forth or oscillated about pivot shaft 59 and vertical axis alpha, thus tending to rotate apparatus 9 reciprocally about axis alpha.

Beneficiation apparatus 9 is supported for oscillation by circumferentially spaced cylindrical rollers 66 carried by U-shaped brackets 67 on a supporting ring assembly 68. Braces 69 extend from standards 52 and 53 and support assembly 68. Housing 10 thus rides on rollers 66 through its limited oscillatory (rotary) movement.

The process utilized by the beneficiation apparatus 9 can be automatically controlled principally by using monitoring and control electronic circuitry, including sensors and valves. Feed conduit 40 is positioned in upper housing 10 so that end 41 is at a desired vertical position, an example of which is depicted in FIG. 1. Particulate material containing ore is fed into beneficiation apparatus 9 through feed conduit 40. The upper level of the particulate material is controlled by the vertical placement of the bottom portion 41 of feed conduit 40. The level of particulate material, of course, will never be higher than the level of the bottom portion 41, within apparatus 9. Water is introduced into apparatus 9 through water feed conduit 42 using water control assembly 70A. Water control valve 70 contained within water feed conduit 42 is an electronically controlled valve which is actuated by sensor 71 and electronic circuitry 72. The placement of sensor 71 is at a position within wall 11, which is below water overflow outlet 5. Water is introduced into apparatus 9 until the upper water level is over sensor 71, as shown in FIG. 1. When sensor 71 is below the water level, electronic circuitry 72 will operate to close electronically controlled water valve 70, thereby maintaining water at the prescribed level. During operation, as water is lost through the system and the water level is below sensor 71, circuitry 72 will again open valve 70 to again bring the water to the prescribed level. Water overflow conduit 5 will direct any water from the system should the water level reach conduit 5. In addition to maintaining utilized to replace excessively dirty water, which is desirable to maintain the efficiency of the process.

Concentrates discharge control assembly 73A functions to control the discharge of concentrates from stratification hoppers 15 and 15A. Assembly 73A includes reference sensor 73 which protrudes into particulate hopper 28, and sensors 74 and 74A which protrude into stratification hoppers 15 and 15A above discharge conduits 16 and 17, respectively. Electronically actuated discharge valves 76 and 76A are controlled by electronic circuitry 75 in response to the signals generated by sensors 73, 74, and 74A. Since heavy metals, such as gold and lead, are unusually good electrical conductors, as the concentration level of the heavy constituents builds up in stratification hoppers 15 and 15A, the electrical resistance between the electrodes of sensors 74 and/or 74A, respectively, will progressively drop. The control circuit 75 is selectively, preprogrammed to open and close valves 76 and/or 76A, or vary the amount by which these valves are opened or closed, in response to this detected resistance. The control 75 may be set to open valves 76 and/or 76A when the sensor detects a very low resistance, so that the heavy constituents are subjected to long exposure time or period of stratification, whereby only the heaviest constituents are passed through valve 76 and 76A. On the other hand, the control 75 can be set for opening valves 76 and/or 76A at a higher resistance, whereby less stratification would have taken place and whereby the discharge material is at a lower concentration of heavy metals. Valves 76 and 76A are actuated by circuitry 75 independently of one another, according to the signal generated by their associated sensor, 74 or 74A, respectively. As stated, sensor 73 is the reference sensor skilled in the art understand the concept of these controls, and also that other known means of density sensing can also be used to perform the function of selective discharge of concentrated ore.

Tailings discharge control assembly 77A includes reference sensor 77, sensor 78, sensor 79, electronically controlled tailings discharge valve 80, and electronic control circuitry 81. As shown in FIG. 1, sensors 77, 78, and 79 project into tailing hopper 8. Sensor 77 is a reference sensor and projects into hopper 8 just below annular lip 18. Sensor 78 controls the opening of electronically controlled valve 80 through circuitry 81, so that when sensor 78 is below the level of particulate material or tailings, valve 80 will be opened to discharge the particulate material contained in hopper 8. Sensor 79 operates to close valve 80 through circuitry 81 so that when the level of particulate material is below sensor 79, electronic circuitry 81 will operate the close valve 80. Sensor 79 is placed within hopper 8 at a position above valve 80. Sensor 79, through, circuitry 81 will operate to close valve 80 before hopper 8 is empty of particulate material, thus preventing significant water loss from apparatus 9 through valve 80. Those skilled in the art will understand that all of these electronically controlled apparatuses previously discussed, including the sensors and electronically controlled valves, are conventional and well known in the art, and that other conventional systems can be employed to selectively, electronically control the input and discharge of material from apparatus 9.

Once the apparatus 9 has been filed with particulate material and water to the desired levels as depicted in FIG. 1, the beneficiation process can begin by the oscillation of As is well known in the art, the amplitude and frequency of the oscillation can be controlled by the adjustment of the prime mover (not shown) and the connecting linkage, such as turn buckle 62 and rod 61. As assembly 9 is oscillated, the particulate material in hopper 28 will begin to flow into lower hopper 30 through annular passageway 31. As this oscillatory movement is imparted to the particulate material, the relatively heavier constituents of the particulate material tend to settle by gravity towards the lower areas of stratification hoppers 15 and 15A, thus displacing the relatively lighter constituents. The particulate material flow path through the process is gravity induced, there is no fluvial transport. As the process continues, the relatively heavier constituents will continue to displace the lighter constituents until the lighter constituents will overflow passed annular lip 18 into tailings hopper 8. When the desired concentration of ore is reached in stratification hopper(s) 15 or 15A, electronically controlled valves 76 and/or 76A open to discharge the concentrate from hopper(s) 15 or 15A until the ore concentration level is below that preprogrammed into control circuitry 75. Circuitry 75 will then operate to close valves 76 and 76A, as discussed above. Similarly, throughout the process, the control apparatus 77A automatically operates to discharge tailings from hopper 8 and control apparatus 70A operates to maintain a prescribed water level within housing 10. It is, therefore, apparent that apparatus 9 will function automatically to open and close the appropriate valves to carry out the process continuously, as long as particulate material and water are present.

The stratification of particulate material according to relative weight is accomplished by the relative motion of the particulate material, caused by the oscillation of housing 9, and aided by agitators 44. Since the lowest level of stratification hoppers 15 and 15A is located at the periphery of the process housing, the centrifugal force generated by the oscillatory motion of housing 9 is effectively utilized to enhance the separation stratification process. As stated, while FIG. 1 depicts two stratification hoppers for ease of illustration, additional hoppers 15 can be incorporated into apparatus 9 for the purpose of obtaining optimum performance in a given space, or for the purpose of increasing unit capacity while maintaining optimum performance.

The flow rate of particulate material through the Process circuit is determined to a large extent by the adjustable descent angle 82 of particulate material between deflector lip 26, overflow lip 18, and horizontal plane beta, and also by the operation of valves 76, 76A and 80. Angle 82 can be selectively adjusted by adjusting the vertical position of deflector 20 within housing 10 using the adjustable support assembly 32. As deflector 20 is raised within housing 10, the adjustable angle 82 is increased. The flow rate of particulate material will likewise be increased. The adjusting of the descent angle 82 by this means is a coarse adjustment of the flow rate. Control of the oscillation amplitude and frequency, as described above, accomplishes a fine adjustment of the flow rate.

Figure 3:
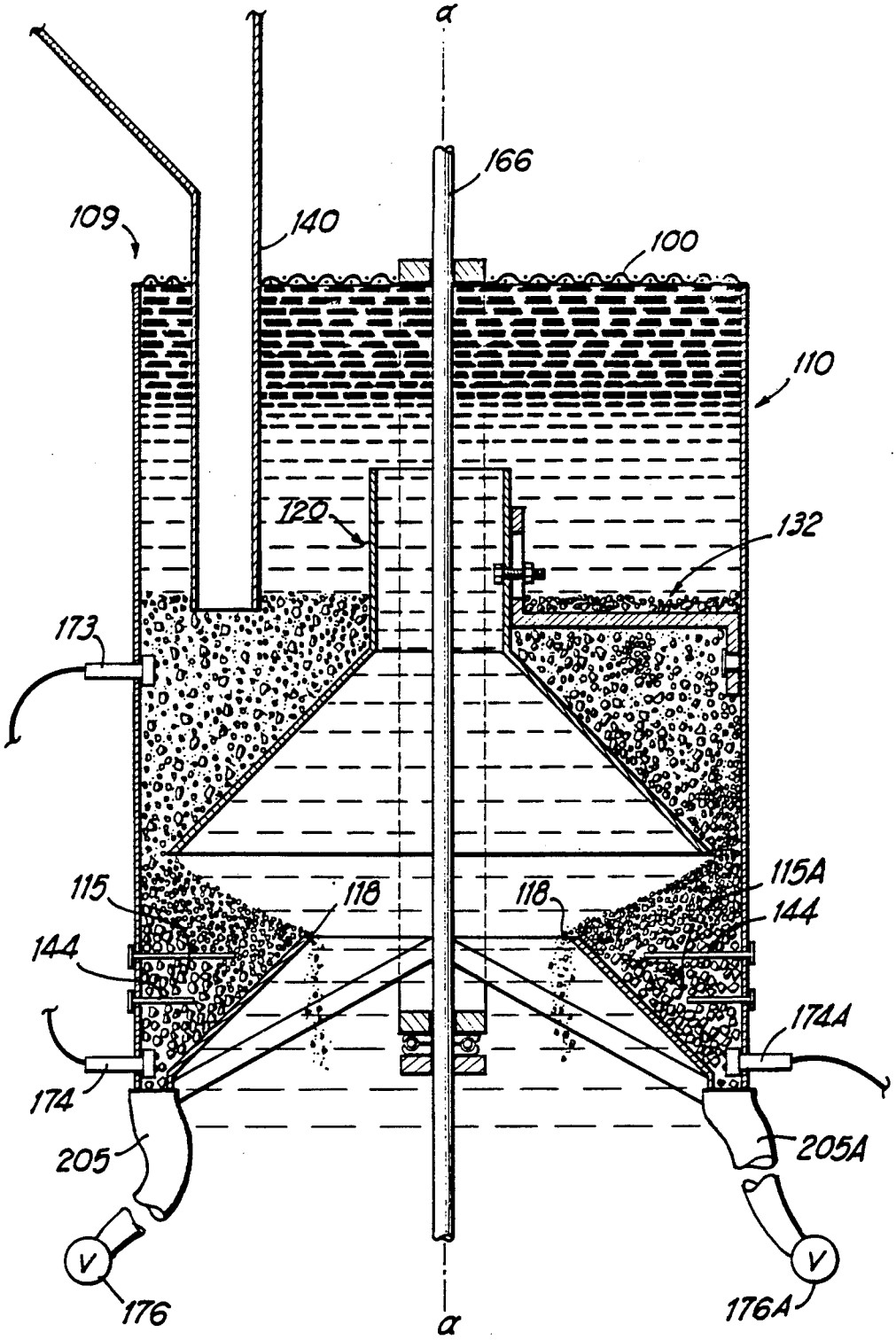
FIG. 3 is a vertical, sectional view of an embodiment of the mineral beneficiation apparatus, adapted for submarine and land applications.

A second embodiment of the present invention can be utilized for both submarine and dry applications on land. For submarine applications a suitable protective screen 100 is attached to the top of housing 110 in order to prevent foreign matter from entering housing 110. Since the entire apparatus 109 is underwater in a submarine environment, the following components are eliminated from the embodiment depicted in FIG. 1: Water feed conduit 42, water inlet control assembly 70A, tailings hopper 8, and tailings discharge assembly 77A. The remaining elements depicted in FIG. 1, as described above, are included as shown in FIG. 3, and function identically as earlier described. The embodiment depicted in FIG. 3 can also be used for dry, land applications with the exception that for dry applications, reference sensor 173 is eliminated, but is retained for submarine applications.

Figure 4:
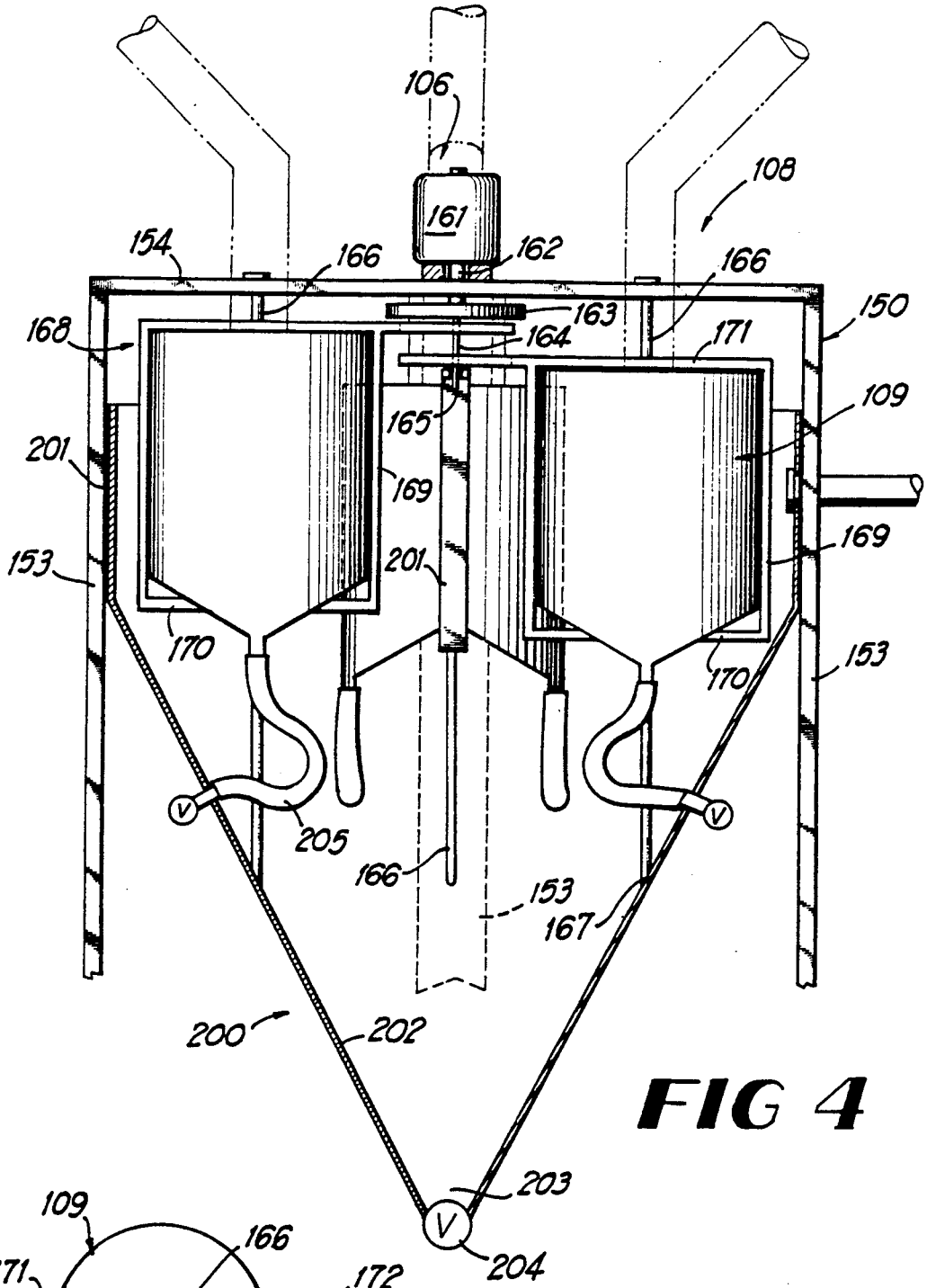
FIG. 4 is a side elevational view of another embodiment of the present invention, in which multiple units are incorporated into a single, large capacity unit.
Figure 4A:
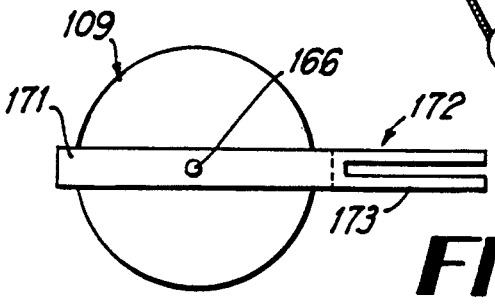
Figure 5:
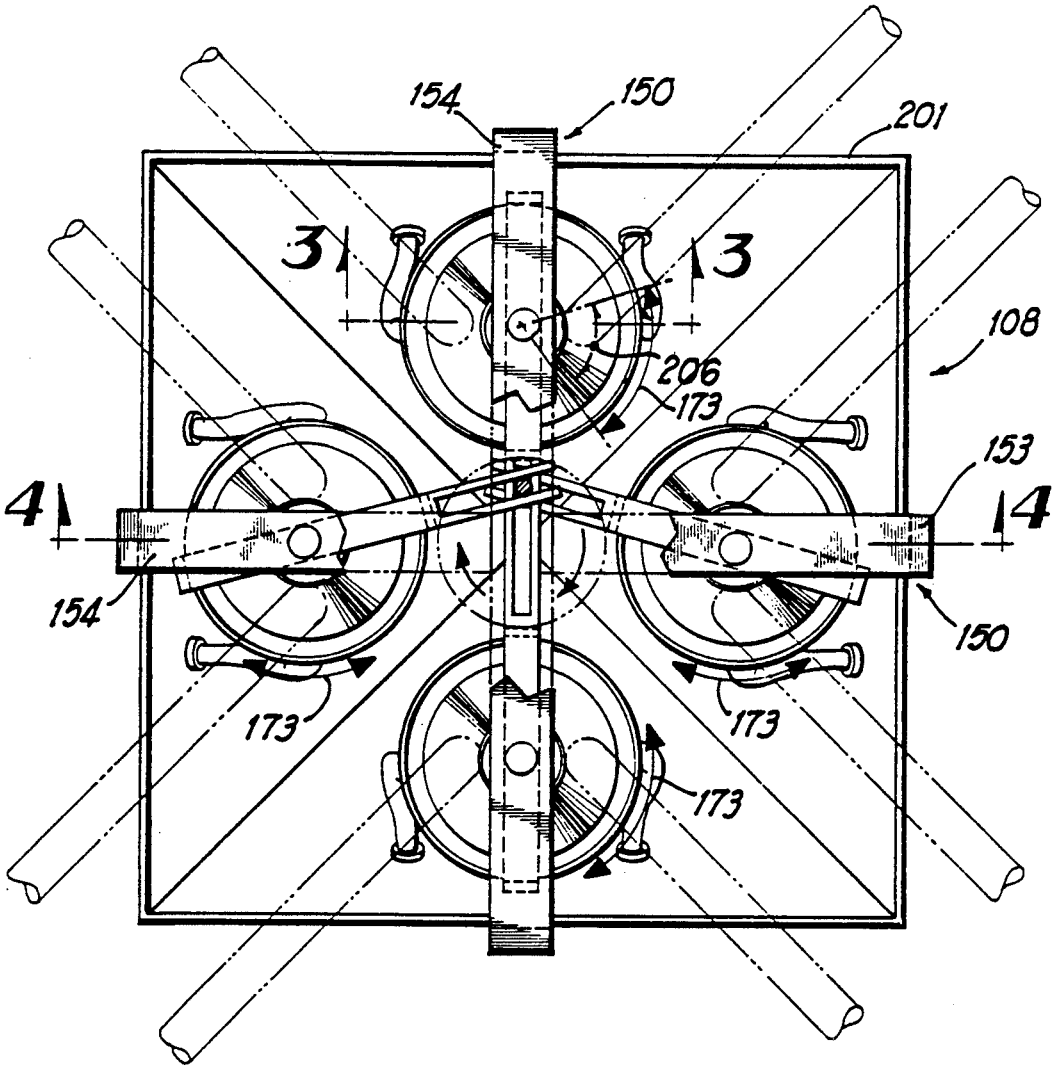
FIG. 5 is a plan view of the embodiment shown in FIG. 4, depicting the top of the frame structure and showing the rocking or oscillation means.

While apparatus 109 is oscillated in a similar, limited rotary path as the embodiment described in FIG. 1, an alternative oscillation assembly 106, can be substituted for assembly 6. FIGS. 4 and 5 depict oscillation assembly 106 for oscillating the beneficiation apparatus 109, and further depict means for incorporating multiple beneficiation apparatuses 109 into a single, large capacity unit 108. Large capacity unit 108 consists of two identical, inverted U-shaped primary frames 150. Each said frame having spaced, parallel upstanding standards or struts 153. The upper ends of the standards 153 are joined by identical, horizontal, laterally extending cross beams 154. These identical cross beams 154 are arranged to cross one another at a normal angle at their mid-sections, as shown in FIG. 5. Supported by and secured to standards 153 is a stationary water tank and tailings collector 200, having conical bottom wall 202. The bottom portion of conical wall 202 terminates in outlet 203 having valve 204. It is thus seen that the attachment of tailings collector 200 to support frame 150 stabilizes support frames 150 as a single unit.

Mounted on beams 154 at their intersection, as depicted in FIG. 4, is oscillating assembly 106 having motor 161. Extending downwardly from motor 161 through a hole in crossbeams 154 is drive shaft 162. Drive shaft 162 is securely fixed at its lower end in concentric relationship to wheel 163. Secured to the bottom of wheel 163, and in eccentric relationship therewith, is drive pin 164 having free end 165.

Support shafts 166 pass through crossbeams 154 as depicted in FIGS. 4 and 5 and are secured to the interior of conical wall 202, at their respective, lower ends 167. Shafts 166 pass through cradle assemblies 168 and beneficiation apparatus 109. Cradle assemblies 168 have upstanding support standards 169, bottom standard 170 and top standard 171, which includes forked rocked arm 172. Each apparatus 109 is securely mounted within its respective cradle assembly 168, to move in a corresponding manner therewith. Apparatus 109 and cradle assembly 168 are supported on and pivot about shafts 166 by any conventionally known bearing assembly. Cradle assembly 168 is thus pivotally supported in an independently rotating relationship with respect to large capacity unit 108. The assemblies 109 are symmetrically spaced in separate quadrants of large capacity unit 108, and arranged so that the tines 173 of arms 172 of each cradle receives drive pin 164. It is thus evident to those skilled in the art that as motor 161 turns wheel 163, drive pin 164 is driven in eccentric relationship to wheel 163. Drive pin 164, therefore, simultaneously drives each rocker arm 172, and therefore, each cradle assembly 168 in a back and forth oscillatory (or limited rotary) motion, as depicted by arrows 173 through angle 206.

Referring to FIG. 5, in operation, assembly 109 is oscillated back and forth by assembly 106. As discussed above with respect to FIG. 1, the movement of the particulate material within each apparatus 109 causes the heavier particles to settle into the lower portions of hoppers 115 and 115A. Thus, the lighter particles are displaced and ultimately pushed over lip 118. The lighter particles then flow into tailings collector 202 where they are discharged through valve 204. The concentrated ore is discharged through conduits 205 and 205A and then through discharge valve(s) 176 and 176A. It is obvious to those skilled in the art that alternatively, the oscillation assembly 6 can be used with the embodiment depicted in FIG. 4, as can oscillation assembly 106 alternatively be used with the apparatus depicted in FIG. 2.

It will further be obvious to those skilled in the art that many variations may be made in the above embodiments here chosen for the purpose of illustrating the present invention, and full result may be had to the doctrine of equivalents without departing from the scope of the present invention, as defined by the appended claims.

What is claimed is:

1. A mineral beneficiation apparatus for separating particulate materials of various weights into a tailings portion and a product portion, comprising:

(a) a housing having a side wall and defining a main chamber therein for containing a quantity of liquid;

(b) a deflector positioned within said main chamber and having a peripheral edge spaced from said side wall for defining a passageway between said peripheral edge and said side wall, wherein said deflector is positioned to partition said main chamber into an upper chamber above said deflector and a lower chamber below said deflector, said upper chamber communicating with said lower chamber through said passageway;

(c) a tailings portion outlet positioned substantially completely beneath said deflector for discharging tailings from said lower chamber;

(d) a stratification hopper positioned below said passageway and extending beneath said peripheral edge of said deflector for collecting particulate material passed through said passageway;

(e) discharge means associated with a lower portion of said stratification hopper for periodically discharging product from said stratification hopper, said discharge means including an outlet and a valve means for controlling discharge of product through said outlet;

(f) material conduit means for introducing particulate material into said upper chamber; and (g) liquid introduction means for introducing liquid into said main chamber for establishing at least a predetermined quantity of liquid in said main chamber.

2. An apparatus as claimed in claim 1 wherein said deflector is generally frusto-conical, said apparatus further comprising a second stratification hopper positioned below said passageway and extending beneath said peripheral edge of said deflector and disposed opposite to the first defined stratification hopper.

3. An apparatus as claimed in claim 1 wherein said housing is generally cylindrical and wherein said tailings portion outlet is positioned concentrically with respect to said housing.

4. An apparatus as claimed in claim 3 wherein said tailings outlet comprises a frusto-conical hopper.

5. An apparatus as claimed in claim 1 further comprising driving means attached to said housing for imparting motion to said housing.

6. An apparatus as claimed in claim 5 wherein said stratification hopper includes projection means mounted within said stratification hopper for agitating the particulate material within said stratification hopper as said housing is moved by said driving means.

7. An apparatus as claimed in claim 1 further comprising sensor means for sensing the concentration of the relatively dense particulate material in said stratification hopper and wherein said valve means is controlled in response to a signal produced by said sensor means.

8. An apparatus as claimed in claim 1 further comprising means for adjusting the position of said deflector within said main chamber.

9. An apparatus as claimed in claim 1 wherein said valve means is electronically controlled and wherein said discharge means further comprises an electronic means for sensing a concentration of particulate material in said stratification hopper.

10. An apparatus as claimed in claim 9 wherein said electronic means for sensing comprises a first electronic sensor mounted in said stratification hopper and a second electronic sensor mounted above said first electronic sensor and in said upper chamber.

11. An apparatus as claimed in claim 1 wherein said stratification hopper has an inlet and wherein said tailings portion outlet is positioned at an elevation within said lower chamber substantially equal to that of said inlet of said stratification hopper.

12. A mineral benefication apparatus for separating particulate materials of various relative densities into a tailings portion and a product portion, said apparatus comprising:

a housing defining a main chamber therein for containing water and particulate material;

means for filling said main chamber with water;

a stratification hopper in fluid communication with said main chamber for collecting particulate material;

a tailings outlet adjacent said stratification hopper;

means for delivering particulate material to said stratification hopper;

means for agitating particulate material collected in said stratification hopper to cause relatively dense particulate material to move lower in said stratification hopper relative to less dense particulate material and to cause the less dense particulate material to eventually overflow from said stratification hopper and into said tailings outlet; and means for periodically discharging particulate material from said stratification hopper to gather the relatively dense particulate material.

13. An apparatus as claimed in claim 12 further comprising a deflector positioned in said main chamber for dividing said main chamber into upper and lower chambers and defining a passageway communicating between said upper and lower chambers, wherein said stratification hopper is positioned below said passageway and said deflector is adapted to direct particulate material from within said upper chamber through said passageway to said stratification hopper.

14. An apparatus as claimed in claim 13 wherein said stratification hopper extends beneath a peripheral edge portion of said deflector and wherein said tailings outlet is positioned substantially completely beneath said deflector.

15. An apparatus as claimed in claim 12 wherein said means for periodically discharging particulate material from said stratification hopper comprises a product outlet formed in a lower portion of said hopper, a valve means associated with said product outlet, sensor means mounted to said stratification hopper for sensing the concentration of relatively dense particulate material collected in said stratification hopper, and control means for operating said valve means in response to said sensor means.

16. A process for separating particulate material into portions according to relative density in a beneficiation apparatus having a housing defining a main chamber therein, a stratification hopper, and a tailings outlet adjacent the stratification hopper, the process comprising the steps of:

(a) filling the main chamber with liquid;

(b) delivering particulate material to the stratification hopper;

(c) collecting particulate material in the stratification hopper;

(d) agitating the particulate material collected in the stratification hopper to cause relatively dense particulate material to move lower in the stratification hopper relative to less dense particulate material;

(e) continuing steps (b) through (d) to cause less dense particulate material to overflow from the stratification hopper and into the tailings outlet; and (f) periodically discharging particulate material from the stratification hopper to gather the relatively dense particulate material.

17. A process as claimed in claim 16 wherein the apparatus has a deflector dividing the main chamber into upper and lower chambers, and wherein the step of delivering particulate material to the stratification hopper comprises delivering particulate material to the upper chamber and directing the particulate material to the stratification hopper with the deflector.

18. A process as claimed in claim 16 wherein the step of agitating the particulate material comprises moving the housing.

19. A process as claimed in claim 16 further comprising the step of monitoring the concentration of relatively dense particulate material in the stratification hopper and wherein the step of periodically discharging the particulate material is performed when the monitor concentration reaches a selected level.

20. A process as claimed in claim 16 further comprising the step of collecting less dense particulate material, which has overflowed from the stratification hopper and into the tailings outlet, in a tailings hopper.

21. A process as claimed in claim 20 further comprising the step of periodically discharging less dense particulate material from the tailings hopper.

22. A process as claimed in claim 16 wherein the steps of delivering particulate material and collecting particulate material are generally non-fluvial and are effected largely by gravity.

23. A mineral beneficiation apparatus for separating particulate materials of various weights into a tailings portion and a product portion, comprising:

(a) a housing having a side wall and defining a main chamber therein and containing a quantity of liquid;

(b) a bottom wall mounted to said housing and defining therein a tailings portion outlet;

(c) a deflector positioned within said main chamber, and having a peripheral edge spaced from said side wall for defining a passageway between said edge and said side wall, wherein said deflector partitions said main chamber into an upper chamber and a lower chamber that communicates through said passageway;

(d) a stratification hopper defined between said side wall and said tailings portion outlet of said bottom wall;

(e) material conduit means for introducing said particulate material into said main chamber; and (f) a liquid overflow discharge outlet mounted in the side wall of said housing.

* * * * *